US005531360A

United States Patent [19]

Berdel et al.

[11] Patent Number: 5,531,360

[45] Date of Patent: Jul. 2, 1996

[54] METERING PALLET

[75] Inventors: Norbert Berdel, Obertshausen; Marian Chojnowski, Biebergemuend, both of Germany

[73] Assignee: Cerdec Aktiengesellschaft Keramische Farben, Frankfurt am Main, Germany

[21] Appl. No.: 274,847

[22] Filed: Jul. 14, 1994

[30] Foreign Application Priority Data

Aug. 2, 1993 [DE] Germany ..... 43 25 908.1

[51] Int. Cl.[6] ..... B67D 5/08; B65D 35/56

[52] U.S. Cl. ..... 222/185.1; 206/386; 222/105

[58] Field of Search ..... 222/181, 185, 222/105; 206/386; 108/51.1; 414/403

[56] References Cited

U.S. PATENT DOCUMENTS

| | | | |
|---|---|---|---|
| 3,162,330 | 12/1964 | Dickson et al. | 222/185 X |
| 3,162,331 | 12/1964 | Hutchins et al. | 222/185 X |
| 3,318,473 | 5/1967 | Jones et al. | 222/185 X |
| 3,464,594 | 9/1969 | Forman | 222/185 |
| 4,817,824 | 4/1989 | LaFleur et al. | 222/105 |
| 4,848,605 | 7/1989 | Wise | 222/185 X |
| 4,966,311 | 10/1990 | Taylor | 222/105 |
| 5,141,135 | 8/1992 | Volk, Jr. | 222/105 |
| 5,184,759 | 2/1993 | Gill et al. | 222/181 |
| 5,257,725 | 11/1993 | Volk, Jr. et al. | 222/185 |
| 5,320,251 | 6/1994 | Ellis | 222/105 |

FOREIGN PATENT DOCUMENTS

| | | | |
|---|---|---|---|
| 2633593 | 1/1990 | France . | |
| 2644135 | 9/1990 | France . | |
| 1816800 | 7/1969 | Germany | 222/185 |
| 2066220 | 7/1981 | United Kingdom . | |
| 2250016 | 5/1992 | United Kingdom . | |

*Primary Examiner*—Bryon P. Gehman

*Attorney, Agent, or Firm*—Beveridge, DeGrandi, Weilacher & Young

[57] ABSTRACT

Bag-like large receptacles (bigbags) have hitherto been adapted for uncontrolled emptying only. Disclosed is a metering pallet for bag-like large receptacles, including a receiving plate (1) above an adjusting frame (4 and 5) with pockets (4*c*) for fork-lift trucks, wherein an upwardly open container (2) is disposed under an opening (9) in the receiving plate (1), the side wall of the container have a device (3) for opening and closing the container, and the underside of the container is connected to a metering device (6).

13 Claims, 4 Drawing Sheets

METERING PALLET

INTRODUCTION AND BACKGROUND

The present invention relates to a metering pallet for bag-like large receptacles, enabling free-flowing bulk material to be removed in a metered manner from the receptacle and enabling the pallet and receptacle to be transported after partial withdrawal and temporarily stored.

It is known to sell free-flowing bulk materials in bag-like large receptacles, usually called bigbags. Bigbags are normally stored on pallets and transported by floor conveyors, particularly fork-lift trucks.

Bigbags with a volume of about 100 liters to 3,000 liters, usually 500 to 2,000 liters, comprise one or more layers of a wide variety of materials, particularly fabrics of synthetic or natural fibers or tapes and sheets; frequently an innerliner of sheet material, e.g. polyolefin, is combined with an outer bag made of tape fabric. In the upper region, the bigbags have a closable filling opening, which is also used for ventilation during emptying, and normally have a number of carrying loops for use with hoists. At the bottom there is usually a bag outlet which when filled is tightened and tied or sewn together with one or more cords.

When bigbags are emptied, they are brought by hoists over the container to be filled. The outlet is opened, e.g. by releasing the closing cords, and the bag empties in an uncontrolled manner. Special devices have been constructed for dust-free emptying of bigbags containing inserted innerliners, but these devices cannot be used for metering or partial withdrawal.

Known devices for metering bulk goods from bigbags comprise a frame for holding the bigbag and a metering machine, the frame and machine together constituting the weight-carrying part of a weighing and metering station. A fork-lift truck or hoist places a bigbag on the weighing and metering station; after the bigbag closure has been opened, the front chamber of the metering machine fills with bulk material, so that a metering screw, in accordance with the preset metering parameters, and optionally a loosening device can be connected and bulk material can be discharged by gravity. These devices can be used for metering, but a partly-emptied bigbag cannot be removed from the receiving frame and transported to another place for temporary storage, without material running out and being wasted and the metering station needing to be cleaned.

Metered partial withdrawal and temporary storage in a reserve store are important particularly in enterprises where multi-component mixtures, including mixtures containing individual substances in small quantities, have to be kept in readiness, but where raw materials have to be brought in bigbags to meet quality, cost and environmental requirements. In enterprises using a large number of bulk materials and/or with frequent changes of product, furthermore, it is impossible for cost and space reasons to install a separate metering and weighing station for every product delivered in bigbags.

SUMMARY OF THE INVENTION

An object of the invention therefore is to provide a device for holding bigbags such that they can be transported and temporarily stored easily and which can also be used for metered partial withdrawal of bulk material. The aim is to obviate the disadvantages of the aforementioned systems by means of the novel device, so that the use of bigbags is no longer an obstacle to a frequent change of product, metered partial withdrawal of the product and temporary storage of partly-emptied bigbags.

The problem encountered in the prior art is solved by a metering pallet. The invention relates to a metering pallet for bag-like large receptacles, comprising a receiving plate (1) above an adjusting frame (4 and 5) with pockets (4*c*) for fork-lift trucks, characterized in that an upwardly open container (2) is disposed under an opening (9) in the receiving plate (1), the side wall of the container comprises a device (3) for opening and closing the container, and the underside of the container is connected to a metering device (6).

According to a preferred embodiment, the metering pallet in claim 1 is characterized in that the metering device is equipped with an iris closure and preferably with a funnel-shaped outlet.

BRIEF DESCRIPTION OF THE DRAWINGS

The invention will be explained in detail with reference to FIGS. 1 to 6; wherein.

DETAILED DESCRIPTION OF THE INVENTION

Figure 1:
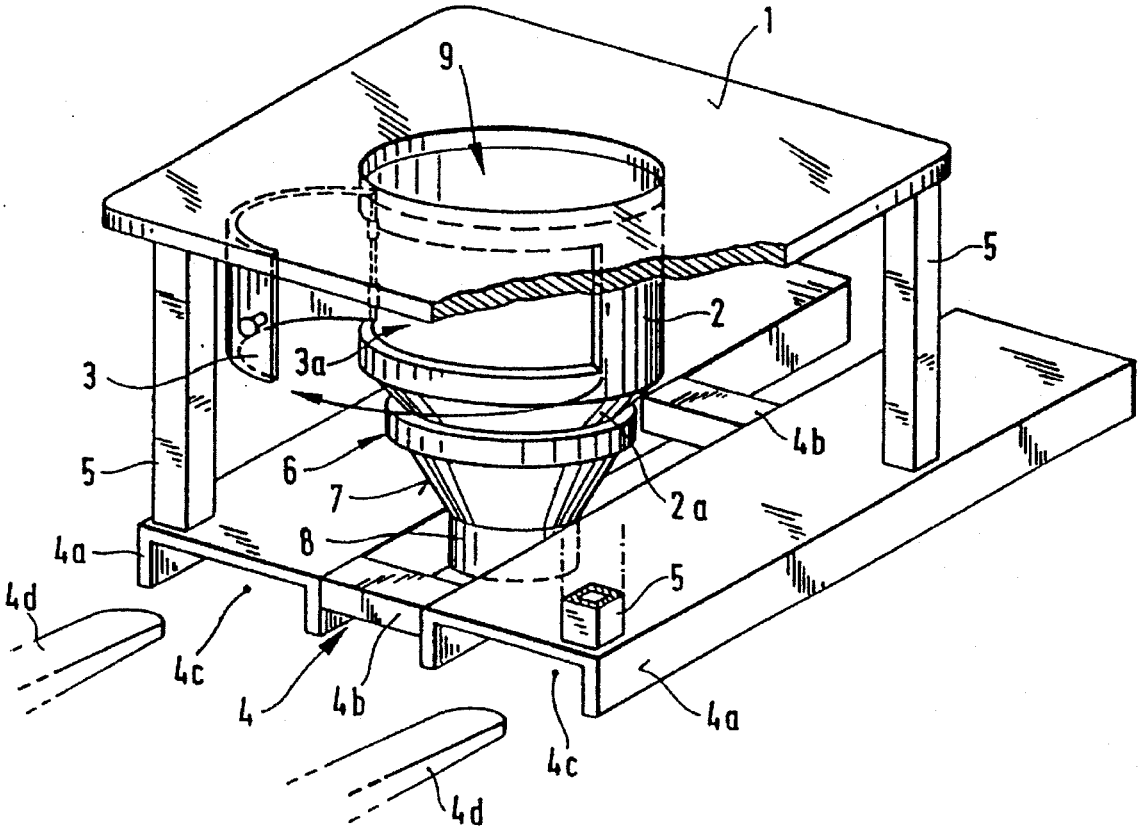
FIG. 1 is an axonometric view of the metering plate of the invention.

The metering pallet shown in FIGS. 1 to 5 corresponds to a preferred embodiment. The top receiving plate (1) which can be generally rectilinear has an opening (9) to accommodate a bigbag (not shown), above a container (2) with an operating flap (3), an operating opening (3*a*) and a funnel (2*a*). The opening (9) is preferably circular and the container (2) is preferably cylindrical, although the size and shape are not critical. The flap (3) forms a door on hinges for easy opening and closing. A metering means (6) is in the lower portion of the container and below that there is an outlet funnel (7) and an outlet nozzle (8). Although shown as a rectangular plate (1), the plate can be square or any convenient size or shape adapted to the particular task. The opening (9), although preferably circular can be any convenient shape. Likewise the container (2) can be cylindrical or any other suitable shape. The opening door (3) forms an arcuate portion of the cylindrical wall of the container (2). The adjusting frame comprises a baseplate (4) of generally rectilinear dimensions, with form supports in the form of vertical post connections (5), to the top plate (1). The baseplate is made up of a pair of U-rails of (4*a*) and bar shape connections (4*b*) to hold the pair of U-rails together. Pockets (4*c*) are found in the underside of the U-rails for receiving the forks (4*d*) of fork-lift trucks (not shown).

The receiving plate (1) formed with an opening for the container (2) preferably comprises a single solid plate but can be perforated. However, the term "receiving plate" also includes systems comprising a number of parts, such as interconnected strips. The size and shape of the receiving plate, which can additionally comprise lateral supporting elements, is such as to obtain a substantially flat or concave (recessed) surface for securely holding the bigbag which is mounted thereon in actual operation.

Figure 2:
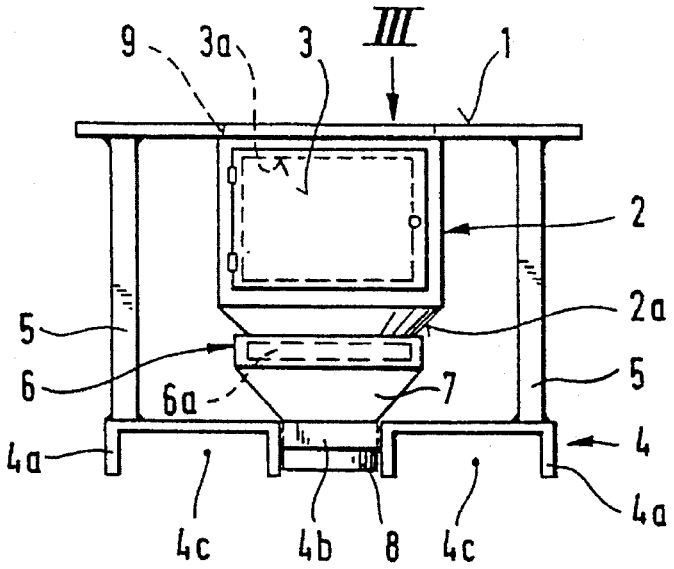
FIG. 2 is a front elevation view of the device of the invention.
Figure 3:
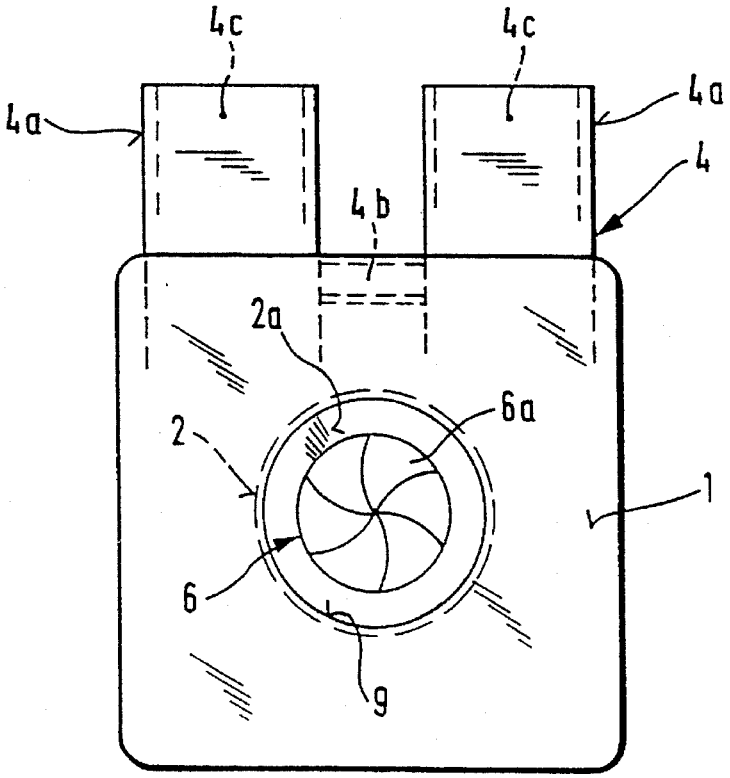
FIG. 3 is a top plan view of the device of the invention.
Figure 4:
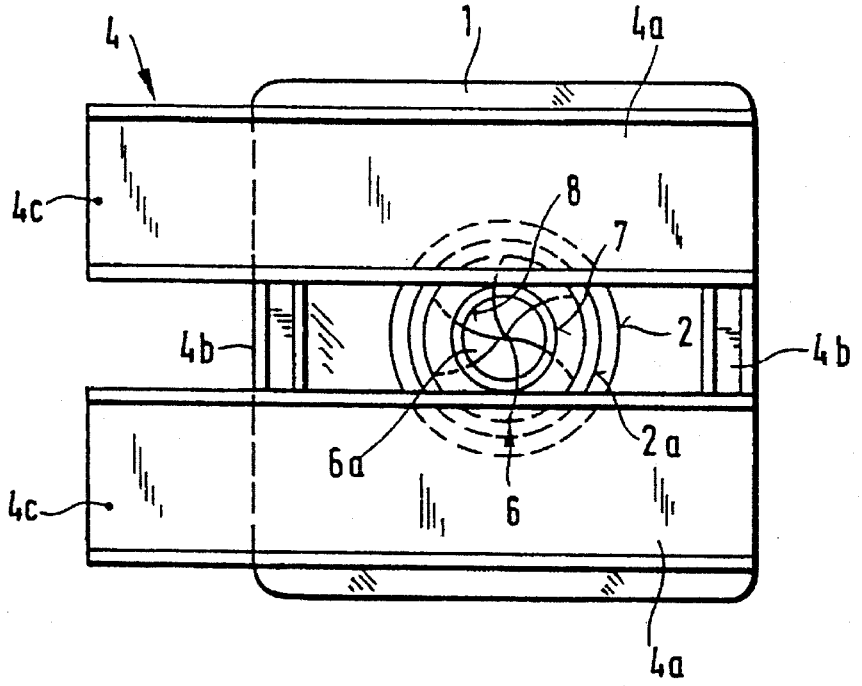
FIG. 4 is a bottom view from underneath of the device of the invention.
Figure 5:
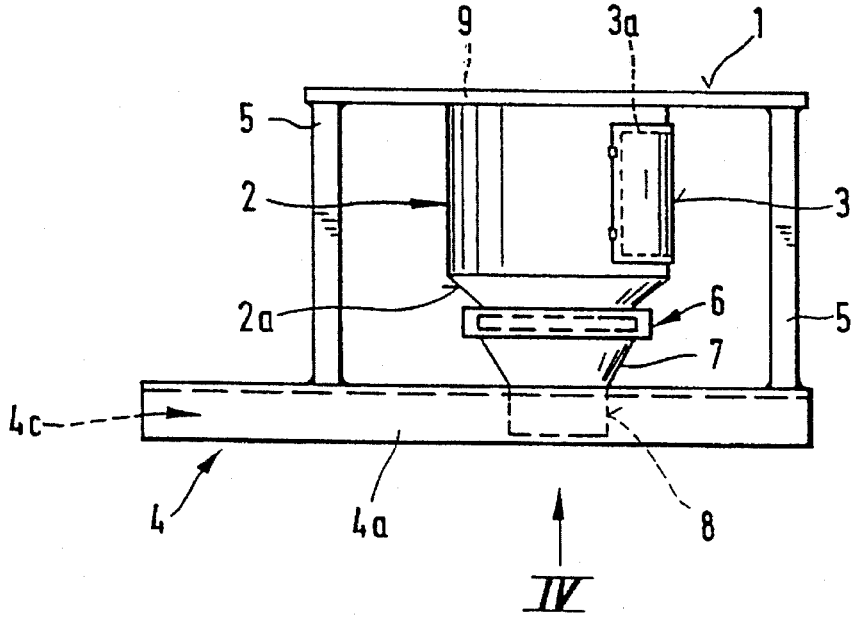
FIG. 5 is a side elevation view of the metering pallet of the invention.

As shown in FIG. 2, the container (2), with the operating opening (3*a*), which is closable by a flap (3) or the like, is preferably cylindrical, but other shapes such as a funnel or rectangular embodiment are possible in principle. The diameter and height of the container are chosen so that it can hold the complete bag outlet in the opened or closed state, without parts thereof reaching the metering device (6). The operating opening and the closure device must be dimensioned so that the bag outlet and an innerliner if present can be opened without difficulty and folded over if necessary. The underside of the container is connected to a conventional metering device (6), which therefore constitutes the termination of the container on the floor.

A variety of metering devices can be used. For example, the metering device can be in the form of a manually, pneumatically or electrically adjustable slide or an iris shutter or an electrically operated bucket wheel or metering screw. As shown in FIG. 2, particularly advantageously, the metering device (6) comprises an iris shutter (6*a*) and an outlet funnel (7), and an outlet nozzle (8) if necessary. This iris shutter is shown in the top plan view of FIG. 3.

The frame for supporting the receiving plate has a height at least equal to the overall height of the container and metering device. The frame can be constructed in any suitable manner, usually of metal or strong plastic and comprises at least one baseplate (4) formed with pockets (4*c*) for fork-lift trucks and connections (5) between the baseplate (4) and the receiving plate (1). For example the side connections (5) between top plate 1 and bottom plate 4 can be in the form of column supports or webs or a side wall on two or three sides of the pallet. The baseplate (4) of the adjusting frame comprises pockets (4*c*), approximately in the form of U-shaped rails (4*a*) connected by webs (4*b*). The construction and arrangement of the pockets will depend on the dimensions of the fork-lift trucks and/or other floor conveyors.

Figure 6:
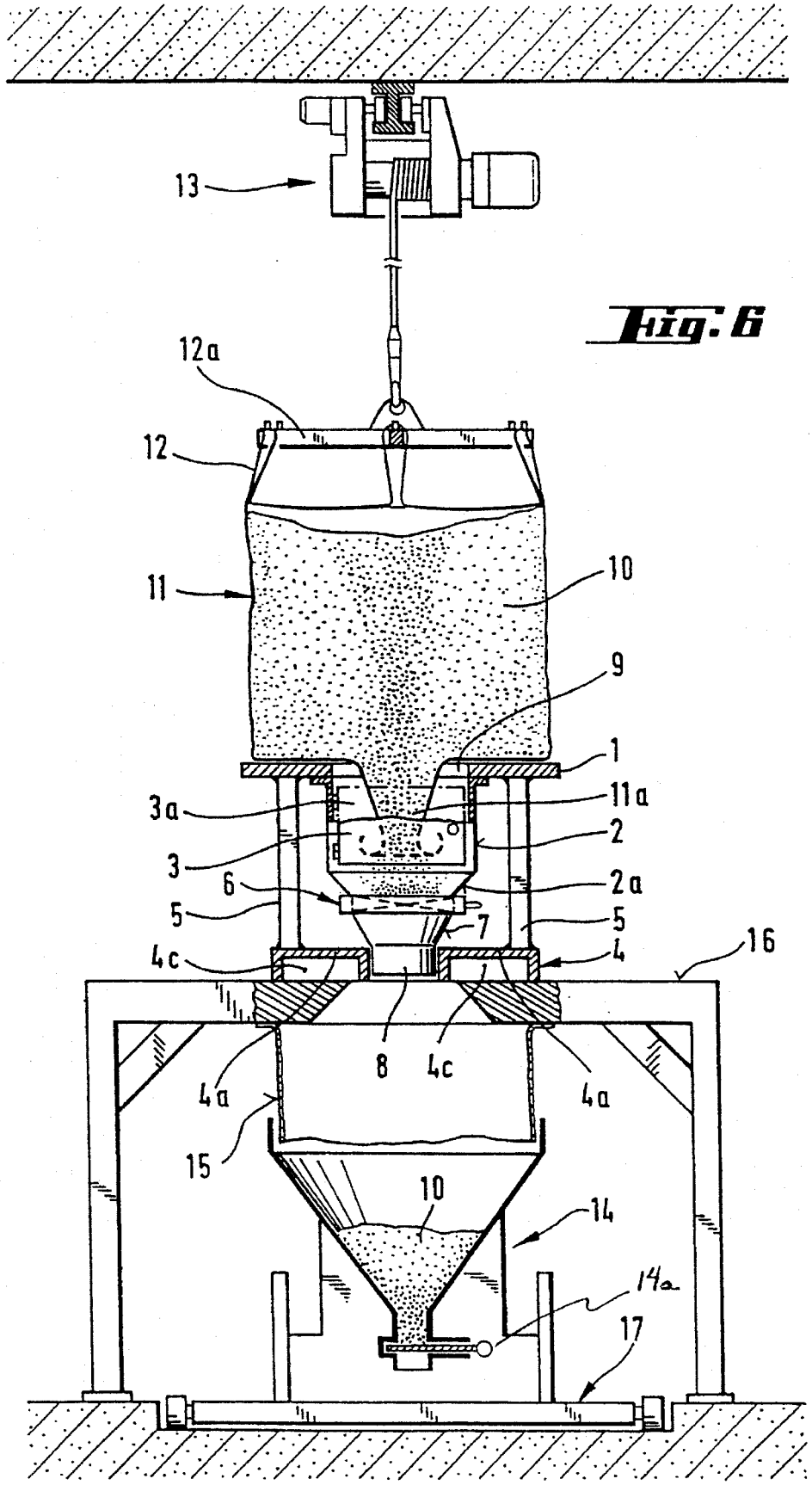
FIG. 6 is a schematic partial sectional view of a metering station comprising a metering pallet according to the invention bearing a bigbag (11) with an opened outlet, a hoist (13) with a spider (12*a*) for the bigbag, an adjusting platform (16) for holding the metering pallet and a movable container (14) underneath for receiving the bulk material on a weighing platform (17).

Operation of the metering plate with a bigbag and with or without an innerliner can be seen from the schematic drawing in FIG. 6 and comprises the following steps: the metering device (6) of the pallet is closed after a fork-lift truck has placed the pallet on an adjusting platform (16). The fork-lift truck or hoist places the full bigbag (11) on the receiving plate (1) of the metering pallet, and inserts the closed outlet of the bigbag through the opening (9) into the container (2). The operating flap (3) is opened, the first cord (not shown) of the outlet of the bigbag is loosened, the bag outlet if necessary is folded over or turned inside-out to adjust it to the container length; the second cord (not shown) of the outlet is loosened, whereupon the outlet of the bigbag (11*a*) and a part of the container (2) fill with metered material (10); the flap (3) is closed, and the opening means of the metering device, e.g. the iris shutter (6*a*) is opened for metering as required into a container located below the metering pallet. During the withdrawal operation, the bag is advantageously held tightly by suspending the loops (12) of the bigbag in a spider (12*a*) or other suitable frame for holding the bigbag and suspending the spider from a hoist (13). If bridges form, they can be removed by actuating the hoist. The metered material (10) falls into a product collection container, such as a movable weighing container (14) with an outlet device (14*a*), e.g. a slide resting on a weighing platform (17). A dust curtain (15) prevents dust from escaping outside the metering station. After the bigbag has been partly emptied, the closure on the bigbag is closed. Then the metering pallet and partly emptied bigbag, after closing the metering device and disconnecting the loops, are conveyed to a storage area on a fork-lift truck. Thereafter another metering pallet bearing a full or partly-full bigbag opened into the container (2) can be placed on the adjusting platform. Only the metering means needs to be opened for the metering operation.

The metering pallet according to the invention can be used for transporting and storing bigbags and also for withdrawing any partial quantities therefrom in metered form. The metering pallet and the bigbag constitute a unit, until the bigbag has been completely emptied. After emptying, the empty bigbag can be exchanged for filled bigbags. The metering pallet and bigbag can be transported by fork-lift truck and stored in any pallet stand. Use of the metering pallet according to the invention for bigbags largely eliminates cleaning work and losses of material which inevitably occur in the known devices during a change of product. Owing to the simple, efficient construction of the metering plate and the ease of handling, there are considerable cost savings compared with known devices, and also quality control and logistics of operation are easier.

Further variations and modifications of the foregoing will be apparent to those skilled in the art and are intended to be encompassed by the claims appended hereto.

German priority application P43 25 908.1 is relied on and incorporated herein by reference.

We claim:

1. A metering pallet for use in combination with bigbag receptacles, comprising a top receiving plate connected by a connecting member to a bottom baseplate with pockets for receiving the forks of fork-lift trucks, an upwardly open container positioned between said top receiving plate and said baseplate, and disposed under an opening in the receiving plate, the container having a side wall with an opening, said opening in said side wall being fitted with a means for closing said opening in said side wall, the container having an underside connected to a metering device, and wherein said opening in said sidewall is fitted with a closure door.

2. A metering pallet according to claim 1, wherein the metering device is equipped with an iris shutter.

3. A metering pallet according to claim 1, wherein said container further has an outlet nozzle at its lowermost end.

4. A metering pallet according to claim 1, wherein said baseplate is formed of a pair of U-shaped parallel members joined together by connecting bars and forming an opening for the lower end of the container.

5. The metering pallet according to claim 1, wherein said baseplate has an opening formed therein for receiving the lowermost end of said container.

6. The metering pallet according to claim 1 wherein said container is a cylindrical body.

7. The metering pallet according to claim 1 wherein said top of said container fits into a circular opening in said top receiving plate.

8. A metering pallet for use in combination with bigbag receptacles, comprising a top receiving plate connected by a connecting member to a bottom baseplate with pockets for receiving the forks of fork-lift trucks, an upwardly open container positioned between said top receiving plate and said baseplate, and disposed under an opening in the receiving plate, the container having a side wall with an opening, said opening being fitted with a means for closing said opening in said side wall, the container having an underside connected to a metering device wherein said container is a cylindrical body, said means for closing said opening in said side wall including a closure door, the top of said container fitting into a circular opening in said top receiving plate, the container having a first funnel shaped portion proximate its lower end, said funnel shaped portion fitting into a metering device, the metering device being fitted into the top of a second funnel shaped section.

9. A metering pallet for use in combination with bigbag receptacles, comprising a top receiving plate connected by a connecting member to a bottom base plate with pockets for receiving the forks of a fork lift truck, an upwardly open container positioned between said top receiving plate and said base plate and disposed under an opening in the receiving plate, the container having a side wall with an opening, said opening in said side wall being fitted with closing means for closing said opening in said side wall, the container having an underside connected to a metering device, said means for closing said opening in said sidewall including a closure door, the top of said container fitting into an opening in said top receiving plate, the container having a shaped portion proximate its lower end, said shaped portion fitting into a metering device, the metering device being fitted into the top of a second shaped section.

10. A metering pallet for use in combination with bigbag receptacles, comprising a top receiving plate connected by a connecting member to a bottom baseplate with pockets for receiving the forks of fork-lift trucks, an upwardly open container positioned between said top receiving plate and said baseplate, and disposed under an opening in the receiving plate, the container having a side wall with an opening, said opening in said side wall being fitted with a means for closing said opening in said side wall, the container having an underside connected to a metering device, and wherein said container has a first funnel shaped portion proximate its lower end, said funnel shaped portion fitting into a metering device, the metering device being fitted into the top of a second funnel shaped section.

11. A metering pallet for use in combination with bigbag receptacles, comprising:

a top receiving plate having an opening for receiving a bigbag receptacle;

a bottom baseplate with pockets for receiving the forks of fork-lift trucks, form supports extending between said top receiving plate and said bottom baseplate and connected with said top receiving plate and said bottom baseplate;

an upwardly open container positioned between said top receiving plate and said baseplate, and disposed under the opening in the receiving plate, said container having a side wall with an opening formed therein, said opening in said side wall and said form supports being dimensioned and arranged such that a bag outlet of a bigbag supported by said top receiving plate can be opened and closed by access gained through said opening in the side wall;

a closure supported by said container and dimensioned so as to cover the opening when not in use; and a metering device connected to an underside of the container.

12. The metering pallet according to claim 11 wherein said form supports include a plurality of spaced posts, and said container having a first funnel portion at a lower end thereof, and said metering pallet further comprising a second funnel shaped portion having an upper end connected to a bottom of said metering device.

13. The metering pallet according to claim 11 wherein said container contacts both said top receiving plate and said baseplate.

* * * * *